US010711721B2

(12) United States Patent
Mukaihara et al.

(10) Patent No.: US 10,711,721 B2
(45) Date of Patent: Jul. 14, 2020

(54) CONTROL DEVICE FOR ELECTROMAGNETIC FUEL INJECTION VALVE

(71) Applicant: HITACHI AUTOMOTIVE SYSTEMS, LTD., Hitachinaka-shi, Ibaraki (JP)

(72) Inventors: Osamu Mukaihara, Hitachinaka (JP); Masahiro Toyohara, Hitachinaka (JP); Hideharu Ehara, Hitachinaka (JP)

(73) Assignee: HITACHI AUTOMOTIVE SYSTEMS, LTD., Ibaraki (JP)

( * ) Notice: Subject to any disclaimer, the term of this patent is extended or adjusted under 35 U.S.C. 154(b) by 16 days.

(21) Appl. No.: 15/306,269

(22) PCT Filed: Mar. 25, 2015

(86) PCT No.: PCT/JP2015/059020
§ 371 (c)(1),
(2) Date: Oct. 24, 2016

(87) PCT Pub. No.: WO2015/163077
PCT Pub. Date: Oct. 29, 2015

(65) Prior Publication Data

US 2017/0051696 A1 Feb. 23, 2017

(30) Foreign Application Priority Data

Apr. 25, 2014 (JP) ..... 2014-090820

(51) Int. Cl.
*F02D 41/20* (2006.01)
*F02M 51/06* (2006.01)
(Continued)

(52) U.S. Cl.
CPC ..... *F02D 41/20* (2013.01); *F02D 41/2467* (2013.01); *F02M 51/00* (2013.01);
(Continued)

(58) Field of Classification Search
CPC ..... F02D 41/20; F02D 41/2467; F02D 2041/2055; F02D 2041/2003;
(Continued)

(56) References Cited

U.S. PATENT DOCUMENTS 5,878,720 A 3/1999 Anderson et al.
6,298,829 B1 * 10/2001 Welch ..... F02D 41/20 123/467
(Continued)

FOREIGN PATENT DOCUMENTS

EP 1884655 A1 2/2008
JP 06-129323 A 5/1994
(Continued)

OTHER PUBLICATIONS

The Extended European Search Report dated Dec. 11, 2017 for the European Application No. 15783225.4.
(Continued)

*Primary Examiner* — David Hamaoui
(74) *Attorney, Agent, or Firm* — Volpe and Koenig, P.C.

(57) ABSTRACT

Because the relationship of the fuel injection quantity to a designated injection period differs in a half-lift region and a full-lift region, the purpose of the present invention is to bring the flow rate characteristics of an intermediate-lift region close to the flow rate characteristics of the full-lift region and improve the controllability of small fuel injection quantities. Provided are a peak current supply period in which a valve body of a fuel injection valve causes the magnetic force necessary for a valve-opening action to be generated, and a lift quantity adjustment period in which, after the peak current supply period, a current lower than the peak current is passed for a prescribed period; further
(Continued)

provided is a current interrupt period in which a drive current is rapidly lowered before the lift quantity adjustment period.

8 Claims, 6 Drawing Sheets

(51) Int. Cl.
*F02M 51/00* (2006.01)
*F02M 61/10* (2006.01)
*F02D 41/24* (2006.01)

(52) U.S. Cl.
CPC ..... *F02M 51/06* (2013.01); *F02M 51/0653* (2013.01); *F02M 61/10* (2013.01); *F02D 2041/2003* (2013.01); *F02D 2041/2027* (2013.01); *F02D 2041/2037* (2013.01); *F02D 2041/2055* (2013.01); *F02D 2041/2058* (2013.01)

(58) Field of Classification Search
CPC ..... F02D 2041/202; F02M 51/0653; F02M 61/10; F02M 51/06; F02M 51/00
See application file for complete search history.

(56) References Cited

U.S. PATENT DOCUMENTS 6,766,788 B2 * 7/2004 Xu ..... F02D 41/20 123/490
7,509,946 B2 * 3/2009 Cooke ..... F02D 41/2096 123/498
7,689,343 B2 * 3/2010 Dagci ..... F02D 35/023 123/406.47
8,082,903 B2 * 12/2011 Lehr ..... F02D 41/2096 123/490
8,332,125 B2 * 12/2012 Boee ..... F02D 41/20 123/490
9,228,521 B2 * 1/2016 Imai ..... F02D 41/20
9,388,760 B2 * 7/2016 Katsurahara ..... F02D 41/247
9,926,874 B2 * 3/2018 Kusakabe ..... F02D 41/20
10,502,155 B2 * 12/2019 Toyohara ..... F02D 41/3005
2012/0080536 A1 * 4/2012 Parrish ..... F02D 41/3005 239/5
2012/0318883 A1 * 12/2012 Kusakabe ..... F02D 41/20 239/1
2014/0007847 A1 * 1/2014 Joos ..... F02D 41/2432 123/472
2014/0110508 A1 4/2014 Dames et al.
2014/0366848 A1 12/2014 Fujii et al.

FOREIGN PATENT DOCUMENTS

JP 2002-161832 A 6/2002
JP 2002-266722 A 9/2002
JP 2010-249069 A 11/2010
JP 2013-002400 A 1/2013
JP 2013-144971 A 7/2013
WO 2013/191267 A1 12/2013

OTHER PUBLICATIONS

Office Action in JP counterpart Application No. 2015-514828 dated Sep. 19, 2017.
Japanese Office Action dated Jun. 13, 2017 in the Japanese Application No. 2016-514828.
Japanese Office Action dated May 14, 2019 for the Japanese Patent Application No. 2018-040443.

* cited by examiner

CONTROL DEVICE FOR ELECTROMAGNETIC FUEL INJECTION VALVE

TECHNICAL FIELD

The present invention relates to a control device for electromagnetic fuel injection valve.

BACKGROUND ART

Conventionally, a maximum injection quantity and a minimum injection quantity is defined as indices indicating a performance of a fuel injection valve for injecting fuel into an internal combustion engine. The quantity of fuel that a fuel injection valve can inject by keeping valve-opening of the fuel injection valve for a prescribed period (for example, one second) is defined as the maximum injection quantity. Injecting a larger injection quantity in a unit time is desired for requirement of the maximum injection quantity, and it can be addressed by increasing, as a determination factor, a setting value of a part represented by a valve-body lift quantity (moving quantity) in the fuel injection valve or a nozzle diameter provided in a distal end of the fuel injection valve. Meanwhile, the minimum injection quantity indicates the smallest injection quantity with which the fuel injection valve can stably inject, and the injection quantity is desirably required to be smaller. By the way, the injection quantity with which injection can be stably performed can be inevitably reduced by shortening a valve-opening instruction time for the fuel injection valve. However, the injection quantity varies between injection valves with identical specifications and identical driving instruction time. Therefore, the variation in the injection quantity falling within a prescribed range is set as a requirement.

In recent years, technological development for widening the range (hereinafter referred to as a dynamic range) between the maximum injection quantity and the minimum injection quantity that has been already mentioned is actively made for an electromagnetic fuel injection valve of a direct-injection internal combustion engine in particular. Particularly, so-called half-lift control in which an active fuel injection is controlled from a state where the valve body of the fuel injection valve is not fully open is catching attention for further reducing the minimum injection quantity while keeping the conventional maximum injection quantity.

For example, in the technique of PTL 1, the half-lift control is realized by improving the mechanism of the fuel injection valve such that the lift quantity of the valve body can be fixed to two levels of a high lift and a low lift and by setting a driving current of the fuel injection valve for each level.

In the technique of PTL 2, half-lift control of an electromagnetic fuel injection valve is realized by performing control to supply a valve-opening current for opening the valve body against a fuel pressure upstream of the fuel injection valve for a short period of time to start closing the valve before reaching a state where the valve body is fully open such that the lift quantity of the valve body is in a parabolic motion.

CITATION LIST

Patent Literature

PTL 1: JP 2002-266722 A
PTL 2: JP 2013-2400 A

SUMMARY OF INVENTION

Technical Problem

With the technique of PTL 1, it is necessary to improve the mechanism of the fuel injection valve to realize the half-lift control, and the lift quantity in a half-lift region cannot be changed continuously.

In addition, in the technique described in PTL 2, a specific scheme to continuously changing the lift quantity in the half-lift region in which the fuel injection is finished before the valve body reaches a full-lift state is neither taken into consideration. Further, even if the lift quantity in the half-lift region is variably controlled on the basis of the technique described in PTL 2, a problem that the relationship of a fuel injection quantity with an injection instruction period is different from a full-lift region in which a fuel injection instruction is stopped after the valve body reaches the full-lift position will arise.

An object of the present invention is made in consideration of such a problem and lies in making flow-rate properties in a half-lift region to be closer to flow-rate properties in a full-lift region to improve the controllability of a minute fuel injection quantity.

Solution to Problem

To solve the problem described above, a control device of the present invention is a control device for electromagnetic fuel injection valve that supplies a driving current to a solenoid to open a valve body with a magnetic force and injects a fuel into an internal combustion engine, and is characterized in that a supply period of the driving current includes a peak current supply period in which a magnetic force necessary for a valve-opening action of the valve body is generated, and a lift quantity adjustment period in which a current lower than the peak current is passed for a prescribed period after the peak current supply period. The control device controls, in accordance with a length of the lift quantity adjustment period, at least one of a lift quantity of the valve body, an actual valve-opening period before the valve body reaches a full-lift position, and a fuel injection quantity injected into the internal combustion engine before the valve body reaches the full-lift position.

Advantageous Effects of Invention

According to the present invention, it is possible to make the relationships of a fuel injection quantity with an injection instruction period of a half-lift region and a full-lift region closer to each other, and thus it is possible to improve the controllability of a minute fuel injection quantity.

DESCRIPTION OF EMBODIMENTS

Exemplary embodiments of the present invention will be described below with reference to drawings.

First Exemplary Embodiment

Figure 1:
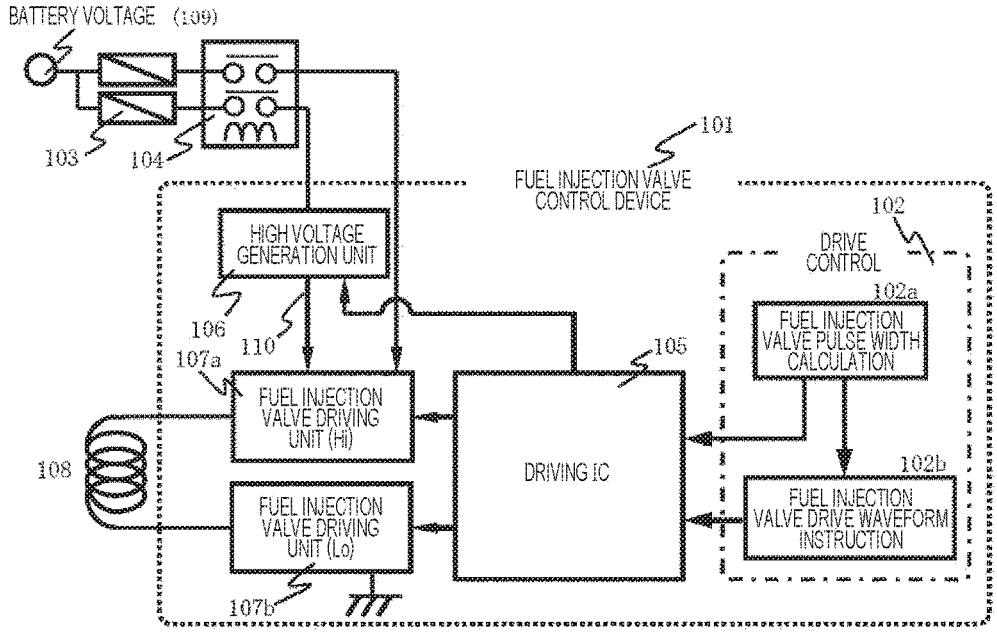
FIG. 1 is an illustration of an overall configuration of the present invention.

FIG. 1 illustrates an example of a basic configuration of a fuel injection control device. First, a battery voltage 109 supplied from an on-vehicle battery is supplied to a fuel injection valve control device 101, which is provided in an engine control unit (hereinafter referred to as ECU) that is not illustrated, via a fuse 103 and a relay 104.

In the present exemplary embodiment, a normally-closed electromagnetic fuel injection valve will be described as a fuel injection valve 108 controlled by the fuel injection valve control device 101. The fuel injection valve 108 drives a valve body in an opening direction by supplying a current to a solenoid to generate a magnetic attractive force and closes the valve in accordance with, for example, a spring force or a supplied combustion power by cutting off the current supplied to the solenoid.

The configuration of the fuel injection valve control device 101 will be described herein. The fuel injection valve control device 101 includes a high voltage generation unit 106 that generates, on the basis of the battery voltage 109, a high power-source voltage (hereinafter referred to as a high voltage 110) required when opening the valve body provided in the fuel injection valve 108, and the high voltage generation unit 106 boosts the battery voltage 109 to reach a desired target high voltage on the basis of an instruction from a driving IC 105. The high voltage generation unit may be implemented by, for example, a booster circuit including a coil, a condenser, and a switching element. As described above, the fuel injection valve 108 is provided with two lines of power sources including the high voltage 110 for securing a valve-opening power of the valve body and the battery voltage 109 that causes the valve body to remain open such that the valve body is not closed after being opened.

In addition, a fuel injection valve driving units 107*a* and 107*b* are provided upstream and downstream of the fuel injection valve 108 and supply a driving current to the fuel injection valve 108. The details will be described later, and thus the description is omitted herein.

The high voltage generation unit 106, the fuel injection valve driving units 107*a* and 107*b* are controlled by the driving IC 105 and apply the high voltage 110 or the battery voltage 109 to the fuel injection valve 108 to achieve a desired driving current. In addition, in the driving IC 105, choosing the driving period of the fuel injection valve 108 (current-passing time of the fuel injection valve 108) and a driving voltage, and a set value of the driving current are controlled on the basis of an instruction value calculated at a fuel injection valve pulse signal calculation block 102*a* and a fuel injection valve drive waveform instruction block 102*b* provided in an in-ECU (not illustrated) block 102.

Figure 2:
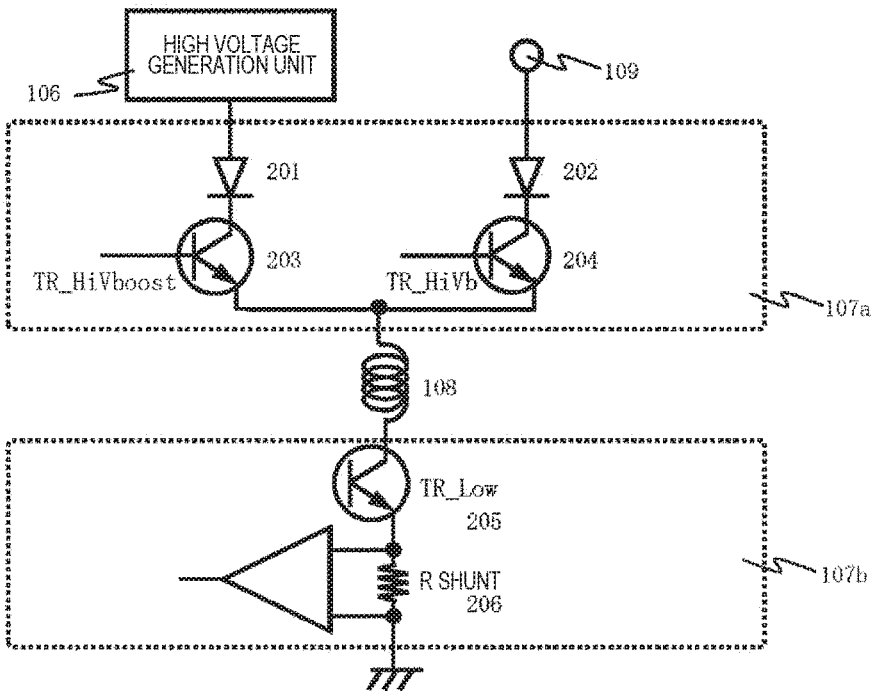
FIG. 2 is a diagram illustrating a configuration of a fuel injection valve control device.

Next, the driving units 107*a* and 107*b* for the fuel injection valve 108 illustrated in FIG. 1 will be described with reference to FIG. 2. As described with reference to FIG. 1, the driving unit 107*a* upstream of the fuel injection valve 108 supplies the high voltage 110 from the high voltage generation unit 106 in the drawing to the fuel injection valve 108 via a diode 201 provided for preventing a countercurrent and by using a switching element of TR_Hivboost 203 in the drawing so as to supply a current required for opening the fuel injection valve 108. Meanwhile, after opening the fuel injection valve 108, the battery voltage 109 required for keeping an open state of the fuel injection valve 108 is supplied to the fuel injection valve 108 via a diode 202 for preventing a countercurrent and by using a switching element of TR_Hivb 204 in a similar manner to the high voltage 110.

Next, the fuel injection valve driving unit 107*b* downstream of the fuel injection valve 108 is provided with a switching element of TR_Low 205. A power source supplied from the fuel injection valve driving unit 107*a* that is upstream can be applied to the fuel injection valve 108 by turning the driving circuit TR_Low 205 on, and desired current control of the fuel injection valve 108 that will be described later is performed by detecting a current consumed by the fuel injection valve 108 with a shunt resistor 206. To be noted, the present description shows an example of a method of driving the fuel injection valve 108, and the battery voltage 109 may be used when opening the fuel injection valve 108 in place of the high voltage 110 in the case where, for example, a fuel pressure is relatively low or the high voltage generation unit 106 has a malfunction.

Next, current control of the fuel injection valve 108 in a conventional technique will be described with reference to FIGS. 3 and 4. Generally, in the case of driving the fuel injection valve 108 of a direct-injection internal combustion engine, a current profile 302 is set beforehand on the basis of properties of the fuel injection valve 108, and the injection quantity property of the fuel injection valve 108 with the current profile 302 is recorded in an ECU (not illustrated). The fuel injection valve control device 101 calculates driving instruction time (hereinafter a pulse signal 301) of the fuel injection valve 108 from an operation state (inhaled air quantity) of an internal combustion engine (not illustrated) and the injection quantity property of the fuel injection valve 108.

Figure 3:
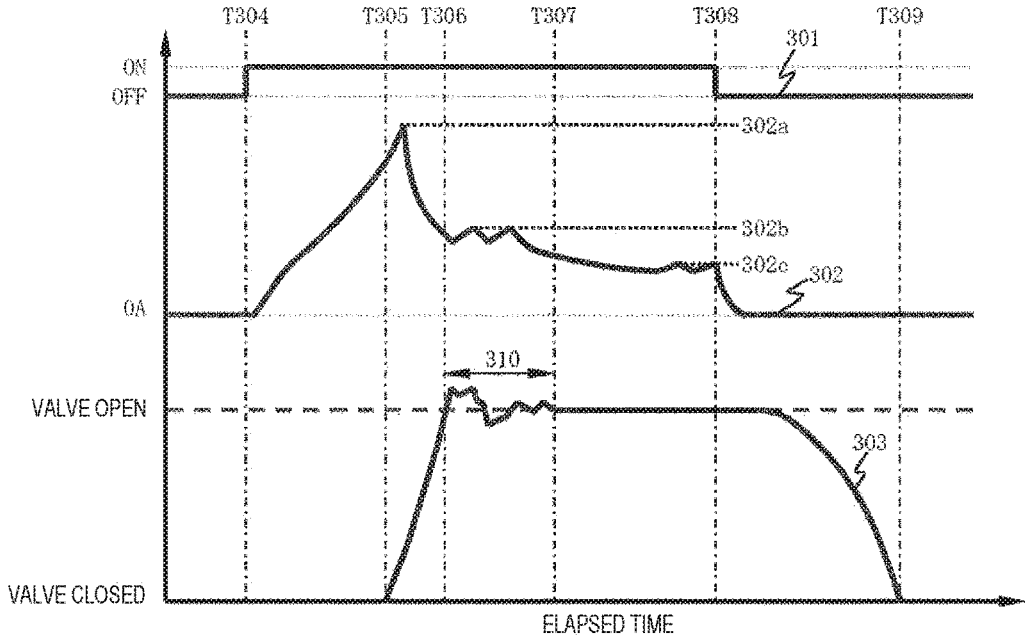
FIG. 3 is an illustration of a conventional method of driving a fuel injection valve.
Figure 4:
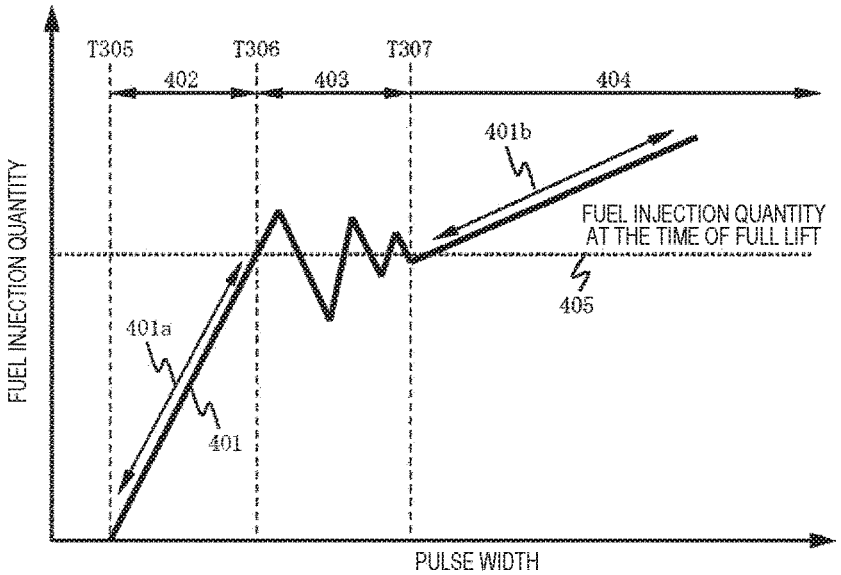
FIG. 4 is a chart illustrating a conventional fuel injection quantity property.

FIG. 3 illustrates an example of this control method. The pulse signal 301 is turned on at a desired injection timing T304 calculated in the ECU, and current control of the fuel injection valve 108 is performed on the basis of the driving current profile 302 recorded in the ECU beforehand.

The driving current profile 302 in the example of FIG. 3 is constituted by a plurality of target current values including a valve-opening peak current 302*a* for opening the fuel injection valve 108 and a first holding current 302*b* and a second holding current 302*c* for holding the valve-open state. The fuel injection valve control device 101 operates the fuel injection valve 108 by switching between the target current values (302*a*, 302*b*, and 302*c* in FIG. 3) on the basis of a control sequence set beforehand, and continues to apply a driving current to the fuel injection valve 108 until T308 at which the pulse signal 301 is turned off.

Next, valve body behavior of the fuel injection valve 108 will be described. After the pulse signal is turned on (T304), the high voltage is applied to the fuel injection valve 108 until reaching the valve-opening current 302*a*. The valve body starts opening at a time point (T305 in FIG. 3) when a residual magnetic field based on electric properties unique to the fuel injection valve reaches a prescribed quantity. The valve body continues valve-opening action thereafter as a result of valve-opening force from the valve-opening current (current behavior until reaching 302A) remaining, and the valve body reaches a stopper position on the valve-opening side (T306). At that time, a surplus opening force causes a bouncing boucing motion of the valve body for some time (period of 301), and the valve body transitions to a stable valve open state (T307). Thereafter, a state in which the valve body is fully open is kept until a time point (T308) at which the pulse signal is turned off. Thereafter, the residual magnetic field of the fuel injection valve 108 is reduced, and the valve body is completely closed (T309) after going through a valve-closing operation. The state in which the valve body is fully open in this behavior is defined as full lift in the present invention. After time T307 at which the full-lift and the stable valve open state is reached, the fuel injection quantity is adjusted by controlling the time in which the position of the full lift is kept by the time in which the first holding current 302*b* and the second holding current 302*c* are supplied.

Next, the injection quantity property in the case of using the driving current 302 illustrated in FIG. 3 will be described with reference to FIG. 4. It has been explained that the fuel injection quantity property is determined from the driving current profile 302 and the period in which the pulse signal 301 is on. In the case where the length of the pulse signal 301 is set as the horizontal axis and the fuel injection quantity per driving time is set as the vertical axis, a property represented by 401 is obtained.

To describe this in detail, in the section 402 between the time point T305 at which the valve body starts to open and the time point T306 at which the valve body reaches the full lift, the fuel injection quantity increases as the lift quantity of the valve body increases on the basis of the supplying time of the valve-opening peak current 302*a*. In this period, since an inclination 401*a* of the fuel injection quantity is determined in accordance with the opening speed of the valve body and the power-source voltage for the peak current is derived from the high voltage 110, a property in which the inclination of 401*a* increases steeply is given.

Thereafter, the valve body collides with a stopper, and thus bouncing also occurs in the fuel injection quantity property due to the bouncing motion 310 that has been already described (period from T306 to T307). This bouncing period 403 is generally not used because of, for example, large differences in properties between fuel injection valves or poor reproducibility between injection operations.

Thereafter, the valve body after the bouncing is settled (T307) has an increasing property with an inclination 401*b* proportional to the length of the pulse signal for keeping a full-lift position, and the minimum injection quantity of a conventional fuel injection valve 108 is treated as a fuel injection quantity at the time of full lift 405+a surplus quantity.

Next, an example in which half-lift control is performed on the basis of the conventional method of driving the fuel injection valve 108 described with FIG. 3 will be described with reference to FIG. 5. First, the half-lift control of the present invention is defined as performing such an operation that the behavior of the valve body draws a parabola by turning the pulse signal off in the period (period from T305 to T306 in FIG. 3) from the time at which the valve body starts to open to the time at which the valve body comes into contact with the stopper.

Figure 5:
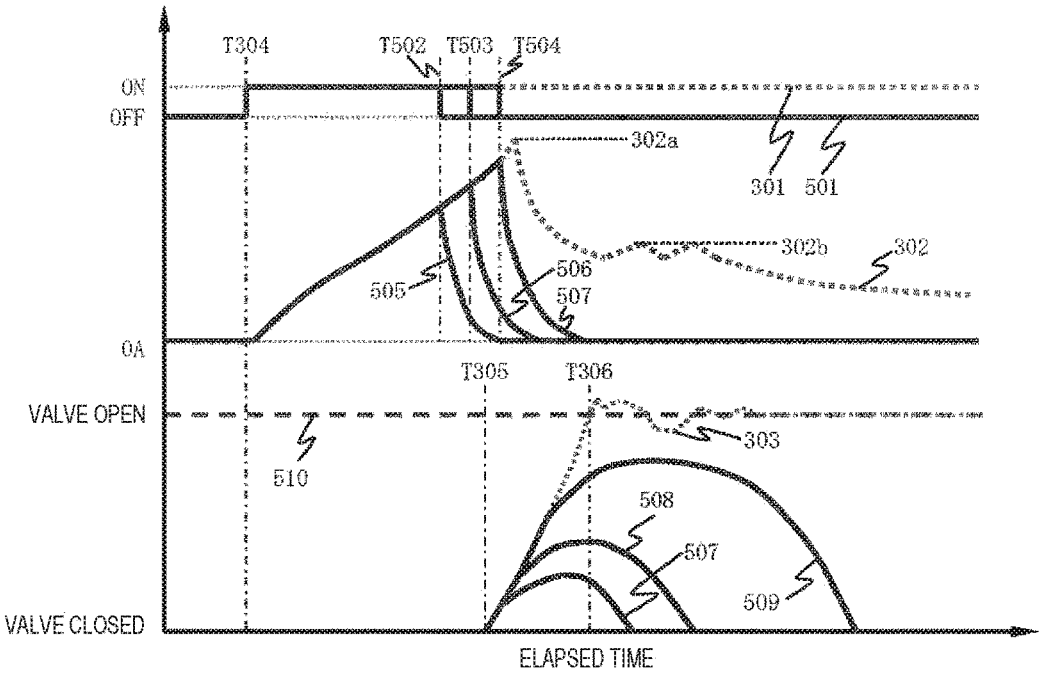
FIG. 5 is an illustration of half-lift control according to conventional control.

In FIG. 5, for easier understanding of a timeline scale, the pulse signal 301, the driving current 302, and the valve behavior 303 at the time of full lift illustrated in FIG. 3 are illustrated by broken lines.

The valve-opening peak current increases after the time point T304 at which a pulse signal 501 is turned on (505, 506, or 507). Thereafter, by turning the pulse signal 501 off at a stage (T502, T503, or T504) before the time point T306 at which the valve body collides with the stopper, T502, T503, and T504 respectively draw loci 505, 506, and 507, and the driving current becomes 0 A. In the case where the valve-opening action is started at T306 after the sequence that has been already described and the pulse signal 501 is turned off at T502, valve behavior represented by 507 is shown. Similarly, 508 is shown for T503, and 509 is shown for T504. Since it is before the valve body collides with the stopper, it becomes possible to perform half-lift control on the valve body behavior. Examples of a problem that arises at this time include a problem that the inclination 401*a* at this time becomes a different property from the inclination 401*b* at a full-lift region since the inclination 401*a* is steep. Specifically, the fuel injection quantity property in this case is the period indicated by 402 in FIG. 4. If the valve-opening peak current is prolonged over T503, the valve body will grow powerfully until reaching a stopper position 510, and thereafter the bouncing motion that has been already described will occur. Therefore, in order to realize the half-lift control illustrated in FIG. 5, it is required to perform control to address the steepness of 401*a*. Specifically, it is required to make the gain of correction of the pulse signal 501 represented by a combustion pressure correction to be adaptable equally to the inclination of the conventional control 401*b*, or make modification to control resolution so as not to use the bouncing period 403.

For example, in the case where a required injection quantity less than the minimum injection quantity that has been already described is calculated in the ECU, a method of not using the period 403 by skipping to the half-lift control period 402 illustrated in FIG. 5 can be considered. It is needless to say that care needs to be taken for differences of injection quantity that occur in this skipping control and the computation for the skipping control becomes complex.

Figure 6:
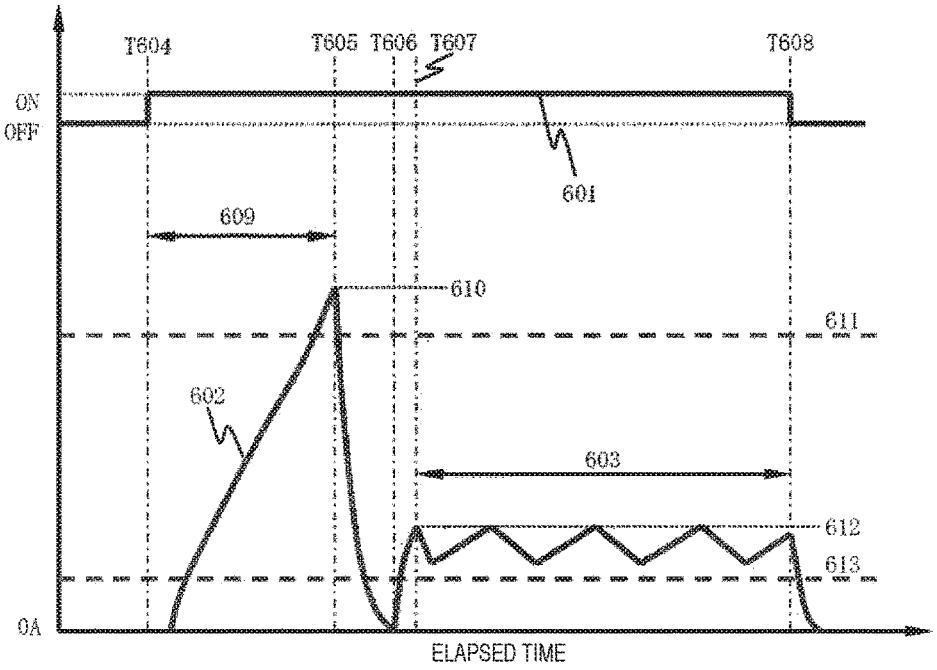
FIG. 6 is an illustration of a method of driving a fuel injection valve according to the present invention.

To solve these problems, the method of driving the fuel injection valve 108 according to the present invention is shown. FIG. 6 is a schematic diagram of a case where full-lift control is performed via a driving method according to the present invention. First, a peak current supply period 609 for generating a magnetic force required for valve-opening action of the valve body provided in the fuel injection valve 108 is provided. In this period, a pulse signal 601 is turned on (T604) and a driving current 602 is until either of reaching a valve-opening peak current value 610 and reaching a prescribed period is satisfied and drives the fuel injection valve 108 with the high voltage 110 similarly to the valve-opening peak current illustrated in FIG. 3.

In addition, this peak current supply period 609 needs to be greater than a valve-openability-guaranteeing minimum current value 611, which enables surely performing valve-opening even under the maximum combustion pressure under which the fuel injection valve 108 is used, or than a period corresponding thereto. That is, this peak current supply period 609 is for generating at least a minimum magnetic force required for performing valve-opening action of the fuel injection valve 108 to guarantee valve-opening of the fuel injection valve.

After the requirement for completing the peak current supply period is satisfied, a lift quantity adjustment period 603 in which a current lower than the peak current is supplied to the fuel injection valve 108 for a prescribed period is provided. This lift quantity adjustment period 603 applies a low voltage represented by the battery voltage 109 to the fuel injection valve 108.

The present invention is characterized by controlling the lift quantity of the valve body in the half-lift state before reaching the full lift in accordance with the length of the lift quantity adjustment period 603. The details of this point will be described later with reference to FIG. 7 and drawings assigned with greater numbers. A target current value 612 of the lift quantity adjustment period 603 needs to be equal to or greater than a valve-opening-holdability-guaranteeing minimum current value 613 that allows holding the valve-open state of the fuel injection valve 108.

In addition, the present invention is characterized by being provided with a current cutoff period (from T605 to T606) for quickly reducing the peak current after the peak current supply period 609 and before transitioning to the lift quantity adjustment period 603. This is for the purpose of counterbalancing an excess valve-opening force (for example, in the case where the combustion pressure is low), which has occurred in the peak current supply period, in the current cutoff period (from T605 to T606). This once cancels the power of the valve body at the time of valve opening, and thus the controllability of the lift quantity in the half-lift state in the lift quantity adjustment period 603 thereafter is improved.

To quickly reduce the peak current in the current cutoff period (from T605 to T606), supply of the high voltage 110 and the battery voltage 109 to the fuel injection valve 108 may be cut off. Further, to quickly reduce the peak current, a negative voltage may be applied to the fuel injection valve 108. To apply the negative voltage, for example, a counter-electromotive force generated in the solenoid of the fuel injection valve 108 may be used. A current passing through the fuel injection valve 108 can be reduced by providing a path that is connected to a ground and the high voltage generation unit 106 (or an on-vehicle power source) via a commutator and serves as an escape for a countercurrent generated in the fuel injection valve 108 due to the counter-electromotive force when the driving units 107*a* and 107*b* are both turned off.

Here, completion requirement during the current cutoff period (from T605 to T606) transitions to the lift quantity adjustment period 603 when either one of a case of being reduced to reach a prescribed current value and a case of a prescribed period having passed is satisfied. When transitioning to the lift quantity adjustment period 603, control is performed via either of the battery voltage 109 and the high voltage 110 such that a target current value 612 is reached.

Next, the valve behavior will be described with reference to FIG. 7 and by the method of driving the fuel injection valve illustrated in FIG. 6. Turning on and turning off of a pulse signal 701 is performed at the same timing as in FIG. 6. For convenience of description, the valve behavior 303 illustrated in FIG. 3 is illustrated by a broken line and referred to as valve behavior 702 in FIG. 6.

In the valve-opening action, with the driving method illustrated in FIG. 3, the lift quantity increases with a high valve-opening speed as 705 and settles in the full-lift position after going through a bouncing period 707, and with the driving method of the present invention illustrated in FIG. 6, behavior represented by 706 is exhibited. This can be achieved mainly by controlling the growth of the valve behavior in the lift quantity adjustment period 603. Stable valve-opening action, that is, half-lift control of the minimum lift quantity is generated from the peak current or the peak current and the current cutoff period (from T605 to T606) (the details will be described with reference to FIG. 8), and increase of the lift quantity thereafter is controlled with the length of the lift quantity adjustment period 603.

Since the lift quantity adjustment period 603 is controlled by the battery voltage 109 and the speed of the valve speed is moderated, the full-lift position is reached in a soft-landed state 708 without the occurrence of a bouncing period 707.

Figure 8:
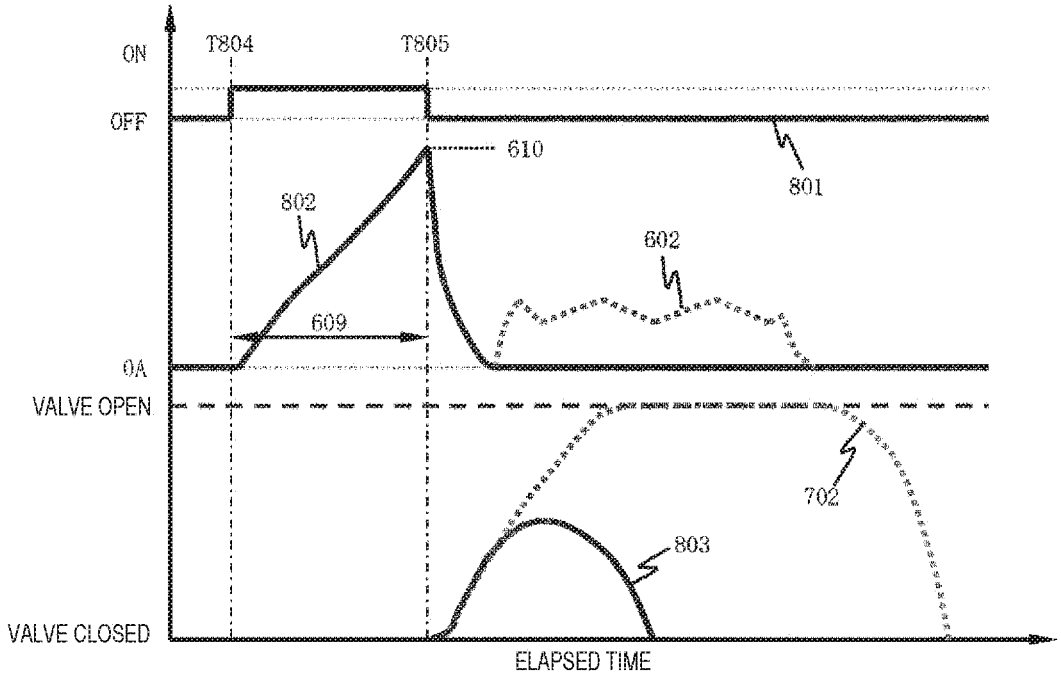
FIG. 8 is an example of a timing chart in a half-lift state according to the present invention.

Next, the half-lift control of the present invention will be described with reference to FIGS. 8 to 10. First, the half-lift control will be described with the minimum lift quantity that has been already described and with reference to FIG. 8. It is assumed that a timing T805 at which a pulse signal 801 in FIG. 8 is turned off is in the current cutoff period (from T605 to T606) from the completion requirement of the peak current supply period 609 described with reference to FIG. 6.

For convenience of description, the driving current 602 of FIG. 6 is illustrated by a broken line, and the valve behavior at that time is illustrated by a broken line 702. In this scene, since a current is supplied to the fuel injection valve 108 only during the peak current supply period 609, a case where driving is performed only with the high voltage 110 is indicated. Although a pulse signal 801 is turned off at T805, since the current cutoff period (from T605 to T606) is provided for the driving current 602 illustrated in FIG. 6, the same locus is also obtained in the case where the pulse signal 801 is turned off in this period.

Valve behavior 803 at this time may be set so as to be the minimum lift quantity of the half-lift control. This is because the peak current supplied in the peak current supply period 609 is required to be set so as to surpass the valve-openability-guaranteeing minimum current value 611 required when opening the fuel injection valve 108, a degree in which difference derived from machine difference and pulsation width with respect to a target combustion pressure is considered even for fuel injection valves 108 with the same properties is assumed, and there is a possibility that the valve body does not open in the case where the current is lower than this. Of course, the peak current has a room for these factors to a certain degree. However, in a basic idea, the electric energy constituted by the peak current supply period 609 or by the peak current supply period 609 and the current cutoff period (from T605 to T606) is the minimum lift quantity having the reproducibility illustrated in FIG. 8.

The description of FIG. 9 will be made on the basis of this. FIG. 9 illustrates the driving current and the valve behavior in the case where the pulse signal 601 is turned off in an arbitrary timing after the turning-off timing of the pulse signal 801 of FIG. 8.

Figure 9:
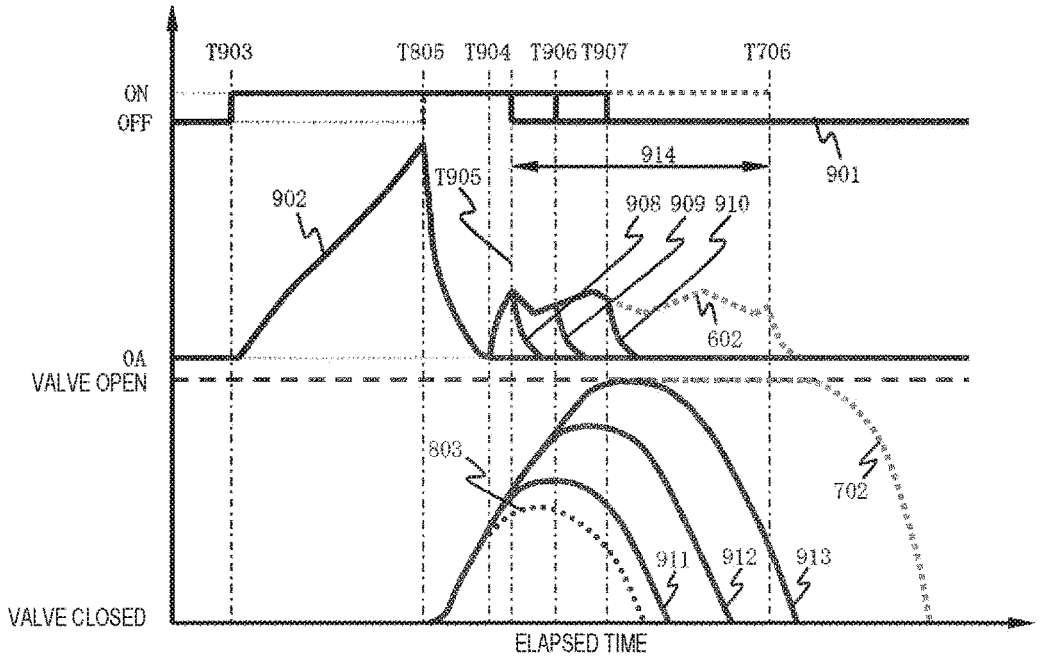
FIG. 9 is another example of a timing chart in a half-lift state according to the present invention.
Figure 10:
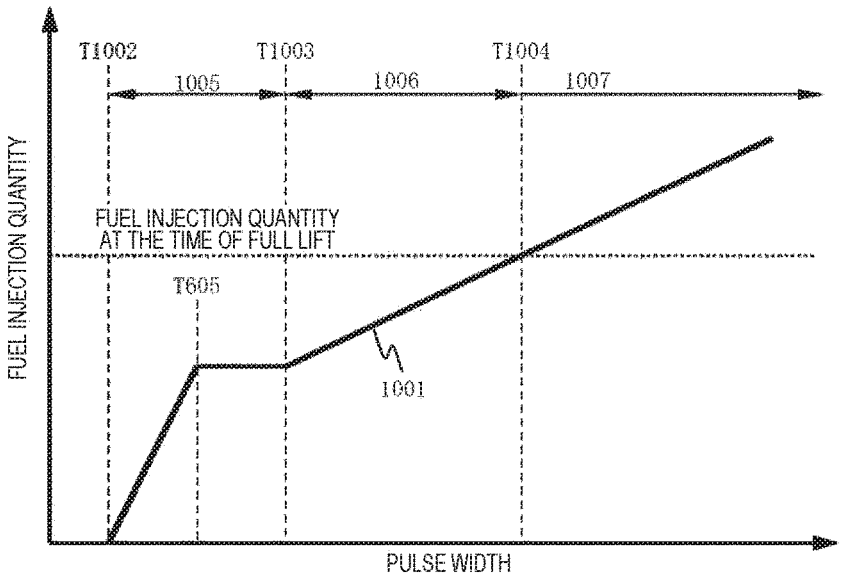
FIG. 10 is an illustration of fuel injection quantity properties according to the present invention.

A pulse signal 901 of FIG. 9 is turned on at T903 and turned off at each timing of T805, T904, T905, T906, and T907. At this time, the driving current becomes the same locus at T805 and T904 as illustrated in FIG. 8. This part has been described with reference to FIG. 8 and is thus omitted. The driving current in the case of turning off the pulse signal at T905 is referred to as 908, and those thereafter will be referred to as 909 and 910, respectively. In addition, the valve behavior in the case of T805 and T904 draws a locus represented by a broken line 803, and in the case of turning off the pulse signal at T905, valve behavior 911 is obtained. Those thereafter will be 912 and 913 in this order. In this way, the valve lift quantity grows in accordance with the length of the pulse signal 901 while tracing the valve behavior 702 at the time of full lift described with reference to FIG. 7. Further, if the peak current supply period 609 and the current cutoff period (from T605 to T606) are set so as to be substantially regular periods, the length of the lift quantity adjustment period 603 will be determined in accordance with the length of the pulse signal 901. In addition, as illustrated in FIG. 8, the valve behavior 803 corresponds to the minimum lift quantity of the present invention and the valve lift quantity thereafter is determined on the basis of the length of the lift quantity adjustment period 603. In other words, an actual valve-opening period or the fuel injection quantity of the fuel injection valve 108 in the half-lift state is controlled on the basis of the length of the lift quantity adjustment period 603.

This enables continuously increasing the lift quantity until reaching the full-lift position without the occurrence of bouncing while providing a smooth valve-opening action. To see this as a fuel injection quantity property, a property illustrated in FIG. 10 is obtained. An injection quantity property 1001 is raised from a time point T1002 at which the valve body starts the valve-opening action until the time point T605 at which the peak current 610 is reached, and transitions to the current cutoff period (from T605 to T606). In the current cutoff period from T605 to T606, the driving current 902 does not change whenever the pulse signal 901 is turned off. Therefore, the valve behavior draws the same locus (T803). Therefore, the injection quantity property 1001 becomes a flat property until a time point T1003 at which the current cutoff period (from T605 to T606) is completed. Thereafter, a current is supplied from the battery voltage 109 as a result of transitioning to the lift quantity adjustment period 603, and the injection quantity property starts to rise again.

As described with the valve behavior of FIG. 9, in the present invention, there is no big difference in the inclination of the injection quantity property between a half-lift period 1006 and a full-lift period 1007. Therefore, the control can be executed without considering the half-lift region and the full-lift region.

In the present invention, the state described with reference to FIG. 8 is the minimum injection quantity. Therefore, the injection quantity at T1003 corresponds to this.

Figure 7:
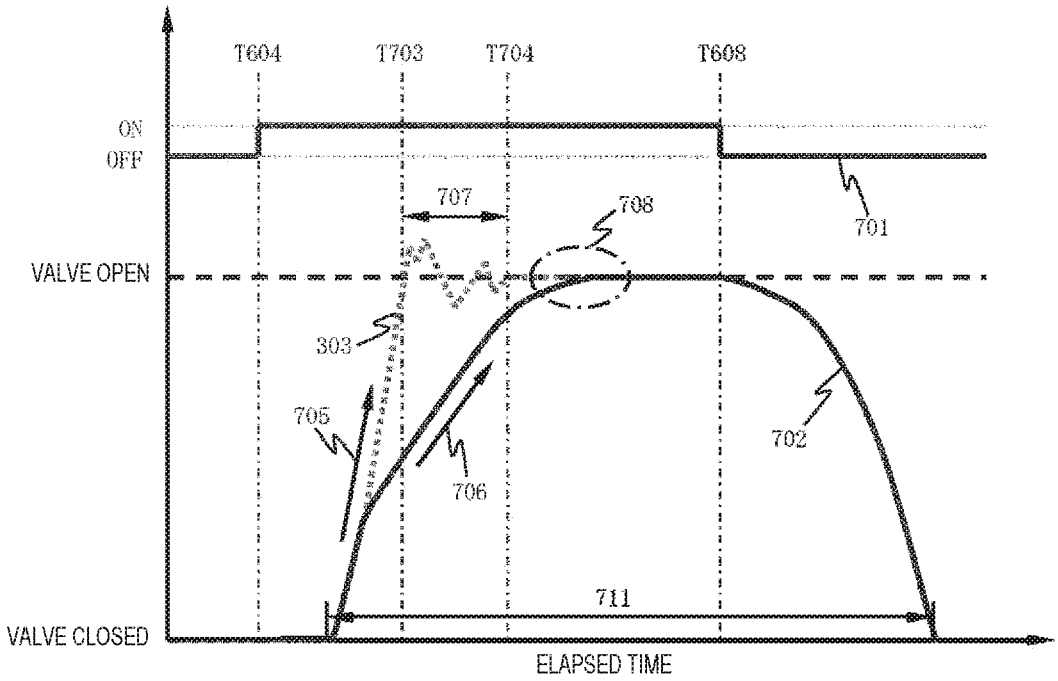
FIG. 7 is an illustration of valve behavior of the fuel injection valve according to the present invention.

The present exemplary embodiment shows an example in which the present invention can be effectively used and includes, for example, making the valve-opening action of the valve behavior 706 illustrated in FIG. 7 to be in an appropriate state by causing the target current value 612 in the lift quantity adjustment period 603 to be variable with a lapse of time. To be noted, the most appropriate state referred to herein indicates causing the inclinations of the injection quantity property 1001 in 1006 and 1007 of FIG. 10 to match each other to such a degree as not to influence the control, and this indicates optimizing the target current value 612 by, for example, fitting.

Second Exemplary Embodiment

Another exemplary embodiment according to the present invention will be described with reference to FIG. 11

In the first exemplary embodiment, the minimum lift quantity has been described with reference to FIG. 8, and a means for further improving the effect in this point will be described.

As has been already described, the stable valve behavior 803 guaranteed by the peak current supply period 609 or by the peak current supply period 609 and the current cutoff period (from T605 to T606), is not necessarily the same between fuel injection valves 108 with identical specifications. That is, changing the length of the peak current supply period 609 or the peak current value 610 due to machine difference of the fuel injection valve 108.

In other words, the valve behavior indicated by 803 in FIG. 8 is desirably similar between a plurality of fuel injection valves 108 provided in the same internal combustion engine. From the results of examination by the inventors of the present invention, it is confirmed that, if the variety of valve behavior at this time is below a certain quantity, the valve lift quantity according to the length of the peak current supply period 609 also grows within that range. Therefore, the current supplied in the peak current supply period 609 is adjusted such that the lift quantity indicated by 803 in FIG. 8 falls within a certain range.

I this case, with a control device including a means capable of directly detecting the valve lift quantity, it is enough as long as at least one of the length of the peak current supply period 609 and the peak current value 610 and one or more of the length of the current cutoff period (from T605 to T606) and the target current during current cutoff are adjusted. Here, adjustment using the actual valve-opening period 711 correlated with the lift quantity will be described.

Figure 11:
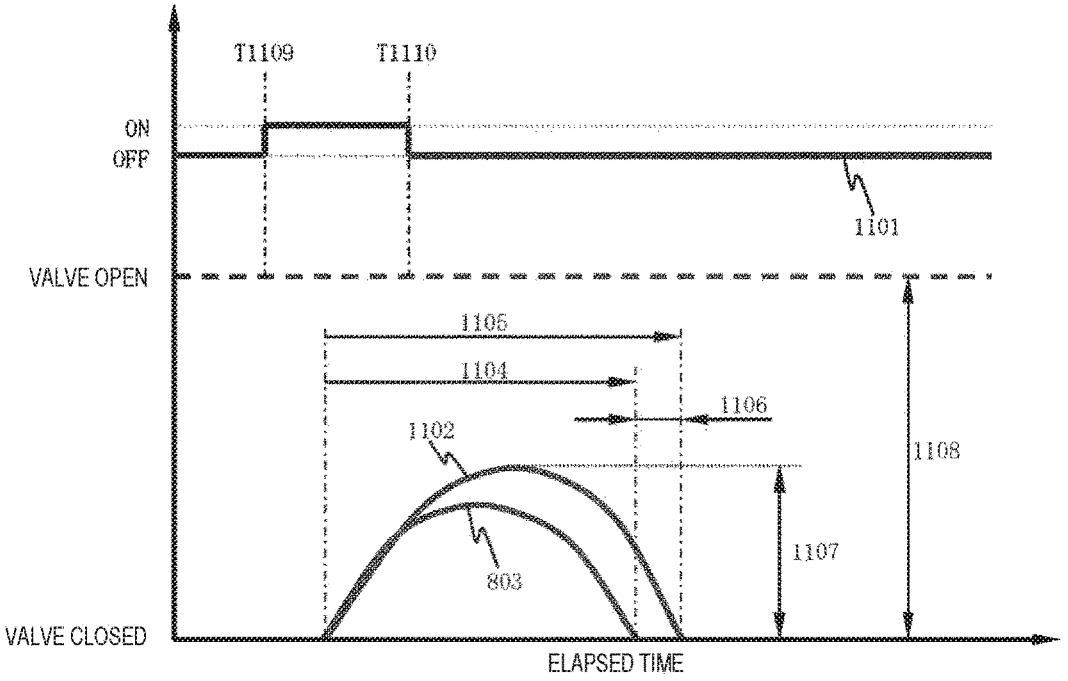
FIG. 11 is an illustration of a driving method of a second exemplary embodiment.

In FIG. 11, the driving current indicates, on the basis of 602 in FIG. 6, valve behavior (803 and 1102) of different fuel injection valves 108 at a timing in which a pulse signal 1101 is the same (on from T1109 to T1110).

In this case, the actual valve-opening period of 803 is 1104 and the actual valve-opening period of 1102 is 1105. By using a function to detect these two periods, difference between the two is eventually calculated and corrected to the peak current supply period 609. Although it is half lift in FIG. 11, the effect can be achieved also with a method of detecting the difference between the two at the time of full lift. In addition, in the case where the difference is at the time of full lift, it is corrected to the length of the peak current supply period 609 or the peak current value 610 by dividing the difference by the ratio with the lift quantity in the peak current supply period 609 to detect the difference in a full-lift quantity 1108.

In addition, the correction at this time is based on an idea of performing relative correction between fuel injection valves 108 provided in the same internal combustion engine, and, for example, the difference from the other fuel injection valves 108 is calculated by setting the longest actual valve-opening period 711 as the standard, and the correction is performed on the full-lift quantity and the peak current supply period 609 and the peak current 610 that serve as bases.

The peak current supply period 609 and the peak current 610 that serve as bases serve as bases indicate, for example, the peak current supply period 609 and the peak current 610 described with reference to FIG. 8 for the fuel injection valve 108 that is the most difficult to open. This enables reducing the variety of the valve lift quantity in FIG. 8 caused by, for example, machine difference.

REFERENCE SIGNS LIST

101 fuel injection valve control device
106 high voltage generation unit
108 fuel injection valve
109 battery voltage
601 pulse signal
602 driving current
603 lift quantity adjustment period
609 peak current supply period
610 peak current value

611 valve-openability-guaranteeing minimum current value
612 target current value
613 valve-opening-holdability-guaranteeing minimum current value

The invention claimed is:

1. A control device for an electromagnetic fuel injection valve that supplies a drive current to a solenoid to open a valve body by magnetic force and injects fuel into an internal combustion engine, a supply period for the drive current comprises a peak current supply period for generating a magnetic force required for the valve-opening operation of the valve body, a current cutoff period for rapidly reducing the peak current after the peak current supply period, and a lift amount adjustment period in which a current smaller than the peak current is supplied for a predetermined period after the current cutoff period, and the control device fixes the current drive profile of the peak current supply period and the current cutoff period to a condition under which the minimum lift amount of the valve body is generated, and the lift amount of the valve body is controlled based on the length of the lift amount adjustment period.

2. The control device for electromagnetic fuel injection valve according to claim 1, wherein injection of fuel is finished in a half-lift state before the valve body reaches the full-lift position, and at least one of the lift quantity of the valve body, the actual valve-opening period, and the fuel injection quantity in the half-lift state increases as the lift quantity adjustment period is prolonged.

3. The control device for electromagnetic fuel injection valve according to claim 2, wherein the supply period of the driving current further comprises the current cutoff period in which the driving current is quickly reduced after the peak current supply period and before the lift quantity adjustment period.

4. The control device for electromagnetic fuel injection valve according to claim 2, wherein the peak current supply period starts based on an ON timing of an injection pulse, the lift quantity adjustment period ends based on an OFF timing of the injection pulse, and the lift quantity adjustment period changes in accordance with a length of the injection pulse.

5. The control device for electromagnetic fuel injection valve according to claim 3, wherein a negative voltage of a counter direction against the battery voltage and the boosted voltage is applied to the solenoid in the current cutoff period.

6. The control device for electromagnetic fuel injection valve according to claim 5, the supply period of the driving current further comprises a current recovery period in which the driving current is quickly recovered after the current cutoff period and before the lift quantity adjustment period, a boosted voltage obtained by boosting the battery voltage to a prescribed voltage is applied to the solenoid in the peak current supply period and the current recovery period, and the battery voltage is applied to the solenoid in the lift quantity adjustment period.

7. The control device for electromagnetic fuel injection valve according to claim 2, wherein the peak current supply period or a current value supplied in the peak current supply period is corrected based on a difference between a plurality of fuel injection valves such that a minimum lift quantity executed by the control device before the valve body reaches the full-lift position falls within a prescribed range among the plurality of fuel injection valves.

8. The control device for electromagnetic fuel injection valve according to claim 7, wherein the peak current supply period or a current value supplied in the peak current supply period is corrected by using a ratio between a lift quantity of the valve body at a time of full lift and the minimum lift quantity.

* * * * *